US009153428B2

(12) United States Patent
Kase et al.

(10) Patent No.: US 9,153,428 B2
(45) Date of Patent: Oct. 6, 2015

(54) DOUBLE-CAPPED SHORT ARC FLASH LAMP

(71) Applicant: USHIO DENKI KABUSHIKI KAISHA, Tokyo (JP)

(72) Inventors: Masahiko Kase, Himeji (JP); Takayuki Hiraishi, Himeji (JP); Hirohisa Ishikawa, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/518,256

(22) Filed: Oct. 20, 2014

(65) Prior Publication Data

US 2015/0115794 A1 Apr. 30, 2015

(30) Foreign Application Priority Data

Oct. 28, 2013 (JP) ..... 2013-222898

(51) Int. Cl.
*H01J 17/30* (2006.01)
*H01J 61/54* (2006.01)
*H01J 61/36* (2006.01)

(52) U.S. Cl.
CPC ..... *H01J 61/545* (2013.01); *H01J 61/361* (2013.01)

(58) Field of Classification Search
CPC ..... H01J 61/34; H01J 61/545
USPC ..... 313/600, 493, 634
See application file for complete search history.

(56) References Cited

FOREIGN PATENT DOCUMENTS

JP 2012-043736 A 3/2012
JP 2012-094362 A 5/2012

*Primary Examiner* — Vip Patel
(74) *Attorney, Agent, or Firm* — Studebaker & Brackett PC

(57) ABSTRACT

A double-capped short arc flash lamp includes an arc tube, a pair of main electrodes disposed in the arc tube, and a pair of auxiliary electrodes disposed in the arc tube. The flash lamp also includes inner leads and outer leads associated with the two auxiliary electrodes, respectively. The flash lamp also includes a first sealing tube and a second sealing tube provided at opposite ends of the arc tube. A sealing glass tube is partly received in the second sealing tube. Grooves are formed in the outer surface of the sealing glass tube in a region where the sealing glass tube overlaps the second sealing tube. The grooves extend in the axial direction of the sealing glass tube, and are configured to receive the inner leads and the outer leads. Metallic foils electrically connect the inner leads with the outer leads, respectively.

20 Claims, 4 Drawing Sheets

DOUBLE-CAPPED SHORT ARC FLASH LAMP

FIELD OF THE INVENTION

The present invention relates to a double-capped short arc flash lamp, and more particularly to a double-capped short arc flash lamp that has a double tube structure at one of sealing tube portions.

DESCRIPTION OF THE RELATED ART

Discharge lamps for flashing (flash lighting) are widely used in industry applications such as flash annealing in a semiconductor manufacturing process or the like. The present invention pertains to a lamp that is particularly suitable to, for example, an exposing process with vacuum ultraviolet light.

The exposing process with the vacuum ultraviolet light requires use of light that can irradiate a small area with high density light in a short time and has relatively small irregularities (unevenness) in the light directivity and distribution, i.e., use of light that is close to parallel light.

One typical example of conventional lamps which are used in the above-mentioned exposing process is a flash lamp having a vacuum tube shape, such as that disclosed in PATENT LITERATURE 1 (Japanese Patent Application Laid-Open Publication No. 2012-43736). This flash lamp has a shorter distance between main electrodes than common flash lamps, and can be handled as a light source that is close to a point source of light.

However, because the lamp has a vacuum tube structure, the lamp should seal two main electrodes and trigger electrodes (auxiliary electrodes for starting/triggering discharge) at one end thereof. Therefore, if a connecting portion (cap, base) to an apparatus or a power source has a column (post, cylindrical) shape, the connecting portion will possess a large outer diameter. When such lamp is used in an optical system having a reflector and/or other components, a light shielding (shading) region increases due to the cap (base) structure and/or other components. As a result, the light output from the optical system drops.

To cope with these shortcomings, PATENT LITERATURE 2 (Japanese Patent Application Laid-Open Publication No. 2012-94362) arranges sealing portions at both ends of the lamp bulb, i.e., employs a double sealing structure. This can reduce the above-mentioned shielding region.

As shown in FIG. 6 of the accompanying drawings, the double-capped short arc flash lamp includes an arc tube (luminous tube) 1, a first sealing tube 2 and a second sealing tube 3 such that the first and second sealing tubes 2 and 3 are provided at the opposite ends of the arc tube 1, respectively and continuously. The combination of the arc tube 1, the first sealing tube 2 and the second sealing tube 3 may be referred to as "lamp bulb." A sealing glass tube 4 is partly received in the second sealing tube 3, and the sealing glass tube 4 is fused and joined to the second sealing tube 3.

In the arc tube 1, a pair of first main electrode 5 and second main electrode 6 are disposed and face each other. The first main electrode 5 has a core wire 7 that is supported by an element such as a graded seal (not shown) and sealed to the first sealing tube 2 with the graded seal. The core wire 7 extends out of the first sealing tube 2. On the other hand, the second main electrode 6 has a core wire 8 that is supported by an element such as a grade seal and sealed to the sealing glass tube 4 with the graded seal. The core wire 8 extends out of the sealing glass tube 4.

Between the two main electrodes 5 and 6 in the arc tube 1, there are provided a pair of auxiliary electrodes 10 and 11 for starting. An inner lead 12 and an outer lead 13 of the upper auxiliary electrode 10 are electrically connected to each other by a metallic foil 14 in a fused area (joint area) between the second sealing tube 3 and the sealing glass tube 4, and an inner lead 15 and an outer lead 16 of the lower auxiliary electrode 11 are electrically connected to each other by a metallic foil 17 in the fused area between the second sealing tube 3 and the sealing glass tube 4.

The above-described double-capped short arc flash lamp has the sealing portions at the opposite ends of the lamp bulb, and therefore the above-mentioned light shielding region is reduced.

As shown in FIG. 7, the lamp having the above-described structure includes the metallic foils 14 and 17, and the inner leads 12 and 15 sealed between the cylindrical second sealing tube 3 and the sealing glass tube 4. Thus, the inner leads 12 and 15 and the outer leads 13 and 16 are easy to move in the circumferential direction of the sealing glass tube 4 when the metallic foils 14 and 17 are sealed to the inner leads 12 and 15. In particular, a careful and intensive work is needed to adjust (fix) the positions of the inner leads 12 and 15, i.e., to adjust (decide) the positions of the auxiliary electrodes 10 and 11. In other words, it is difficult to obtain accurate relative positional relationship between the auxiliary electrodes 10 and 11. The relative positional relationship between the auxiliary electrodes 10 and 11 can be greatly deviated from the desired relative positional relationship.

If such deviation occurs, the distance between the auxiliary electrodes 10 and 11 becomes larger than a prescribed value or smaller than the prescribed value. This makes it difficult to surely trigger the discharge upon turning on the lamp.

In addition, if the deviation occurs in the relative positional relationship between the metallic foils 14, 17 and the inner leads 12, 15 and/or between the metallic foils 14, 17 and the outer leads 13, 16 during the sealing work, the welded portions between the metallic foils 14, 17 and the inner leads 12, 15 and/or between the metallic foils 14, 17 and the outer leads 13, 16 may come off, and the metallic foils 14, 17 may be broken.

In order to eliminate the above-described deviation in the relative position between the auxiliary electrodes 10 and 11, a supporter 20 for position fixing is disposed between the two inner leads 12 and 15 as shown in FIG. 6. The supporter 20 can properly position the auxiliary electrodes 10 and 11, but makes the relevant structure complicated. The supporter 20 also increases the outer diameter of the second sealing tube 3. This in turn enlarges the diameter of the cap (base) that connects the lamp to the apparatus. The enlarged cap increases the light shielding region.

LISTING OF REFERENCES

Patent Literatures

PATENT LITERATURE 1: Japanese Patent Application Laid-Open Publication No. 2012-43736

PATENT LITERATURE 2: Japanese Patent Application Laid-Open Publication No. 2012-94362

SUMMARY OF THE INVENTION

In one aspect of the present invention, the present invention is directed to a double-capped short arc flash lamp that includes an arc tube made of glass. The arc tube has a first end and a second end opposite the first end. The flash lamp also includes a pair of first and second main electrodes disposed in the arc tube, and a pair of first and second auxiliary electrodes disposed in the arc tube. The auxiliary electrodes are used for starting (triggering discharge). The flash lamp also includes a first inner lead and a first outer lead associated with the first auxiliary electrode. The flash lamp also includes a second inner lead and a second outer lead associated with the second auxiliary electrode. The flash lamp also includes a first sealing tube provided at the first end of the arc tube, and a second sealing tube provided at the second end of the arc tube. The flash lamp also includes a first core wire extending from the first main electrode and protruding out of the arc tube (first sealing tube). The first core wire is sealed to the first sealing tube. The flash lamp also includes a sealing glass tube partly received in the second sealing tube. The sealing glass tube is fused and joined to the second sealing tube. The sealing glass tube has an outer surface and an axial direction. The flash lamp also includes a second core wire extending from the second main electrode and protruding out of the arc tube (sealing glass tube). The second core wire is sealed to the sealing glass tube.

An object of the present invention is to provide a double-capped short arc flash lamp that can eliminate the positional deviation (offset, undesired movement) of the inner and outer leads of the auxiliary electrodes when the second sealing tube is fused and sealedly joined to the sealing glass tube. The inner and outer leads of the auxiliary electrodes are placed between the second sealing tube and the sealing glass tube. When the inner and outer leads of the auxiliary electrodes have no positional deviation, accurate positional relationship is established between the two auxiliary electrodes because the auxiliary electrodes are provided at the ends of the inner leads.

Another object of the present invention is to provide a double-capped short arc flash lamp that can avoid breakage of the welded portions between the inner and outer leads and the metallic foils.

Still another object of the present invention is to provide a double-capped short arc flash lamp that does not need a component (supporter) for fixing the positions of the inner leads, and that has the sealing tube with a smaller outer diameter so as to reduce the light shielding region.

Yet another object of the present invention is to provide a double-capped short arc flash lamp that can facilitate and simplify the sealing work.

According to one aspect of the present invention, there is provided a double-capped short arc flash lamp that includes an arc tube made of glass. The arc tube has a first end and a second end opposite the first end. The flash lamp also includes a pair of first and second main electrodes disposed in the arc tube, and a pair of first and second auxiliary electrodes disposed in the arc tube. The auxiliary electrodes are used for starting (triggering discharge). The flash lamp also includes a first inner lead and a first outer lead associated with the first auxiliary electrode. The flash lamp also includes a second inner lead and a second outer lead associated with the second auxiliary electrode. The flash lamp also includes a first sealing tube provided at the first end of the arc tube, and a second sealing tube provided at the second end of the arc tube. The flash lamp also includes a first core wire extending from the first main electrode in the first sealing tube, and protruding out of the first sealing tube. The first core wire is sealed to the first sealing tube. The flash lamp also includes a sealing glass tube partly received in the second sealing tube. The sealing glass tube is fused and joined to the second sealing tube. The sealing glass tube has an outer surface and an axial direction. The flash lamp also includes a second core wire extending from the second main electrode in the sealing glass tube, and protruding out of the sealing glass tube. The second core wire is sealed to the sealing glass tube. The flash lamp also includes a first groove formed in the outer surface of the sealing glass tube in a region where the sealing glass tube overlaps the second sealing tube. The first groove extends in the axial direction of the sealing glass tube, and is configured to receive the first inner lead and the first outer lead. The flash lamp also includes a second groove formed in the outer surface of the sealing glass tube in the region where the sealing glass tube overlaps the second sealing tube. The second groove extends in the axial direction of the sealing glass tube, and is configured to receive the second inner lead and the second outer lead. The second groove is formed at a different location than the first groove. The flash lamp also includes a first metallic foil configured to electrically connect the first inner lead with the first outer lead, and a second metallic foil configured to electrically connect the second inner lead with the second outer lead.

The first metallic foil may be disposed outside the first inner lead and the first outer lead. The second metallic foil may be disposed outside the second inner lead and the second outer lead.

The first groove may not be continuous in the axial direction of the sealing glass tube. The second groove may not be continuous in the axial direction of the sealing glass tube.

That portion of the sealing glass tube which is not received in the second sealing tube may have a reduced diameter.

In the overlapping area between the second sealing tube and the sealing glass tube of the flash lamp, the lead receiving grooves are formed in the outer surface (outer circumference) of the sealing glass tube, and the lead receiving grooves extend in the axial direction of the sealing glass tube. Because the inner leads and outer leads of the auxiliary electrodes are received in the grooves, the inner and outer leads do not deviate (move, shift) from the desired positions when the second sealing tube is fused and sealed to the sealing glass tube. This facilitates and simplifies the sealing work. Also, accurate relative positional relationship is obtained between the two auxiliary electrodes.

Therefore, a separate component for fixing the positions of the auxiliary electrodes is not needed. This simplifies the structure of the flash lamp. Further, the second sealing tube can have a smaller outer diameter. This reduces the light shielding area. In addition, no breakage occurs in the welding joint between the metallic foils and the inner leads and between the metallic foils and the outer leads.

According to another aspect of the present invention, there is provided a double-capped short arc flash lamp that includes an arc tube having a first end and a second end opposite the first end. The flash lamp also include a pair of first and second main electrodes disposed in the arc tube. The flash lamp also includes a pair of first and second auxiliary electrodes disposed in the arc tube. The flash lamp also includes a first lead electrically connected to the first auxiliary electrode, and a second lead electrically connected to the second auxiliary electrode. The flash lamp also includes a first sealing tube extending from the first end of the arc tube, and a second sealing tube extending from the second end of the arc tube. The flash lamp also includes a first core wire extending from the first main electrode and protruding out of the arc tube. The first core wire is sealed to the first sealing tube. The flash lamp also includes a sealing glass tube partly received in the second sealing tube. The sealing glass tube has an outer surface and an axial direction. The flash lamp also includes a second core wire extending from the second main electrode and protruding out of the arc tube. The second core wire is sealed to the sealing glass tube. The flash lamp also includes a first groove formed in the outer surface of the sealing glass tube in a region where the sealing glass tube overlaps the second sealing tube, and extending in the axial direction of the sealing glass tube. The first groove is configured to receive the first lead. The flash lamp also includes a second groove formed in the outer surface of the sealing glass tube in the region where the sealing glass tube overlaps the second sealing tube, and extending in the axial direction of the sealing glass tube. The second groove is configured to receive the second lead, and formed at a different location than the first groove.

These and other objects, aspects and advantages of the present invention will become apparent to a skilled person from the following detailed description when read and understood in conjunction with the appended claims and drawings.

DETAILED DESCRIPTION OF THE INVENTION

First Embodiment

Figure 1:
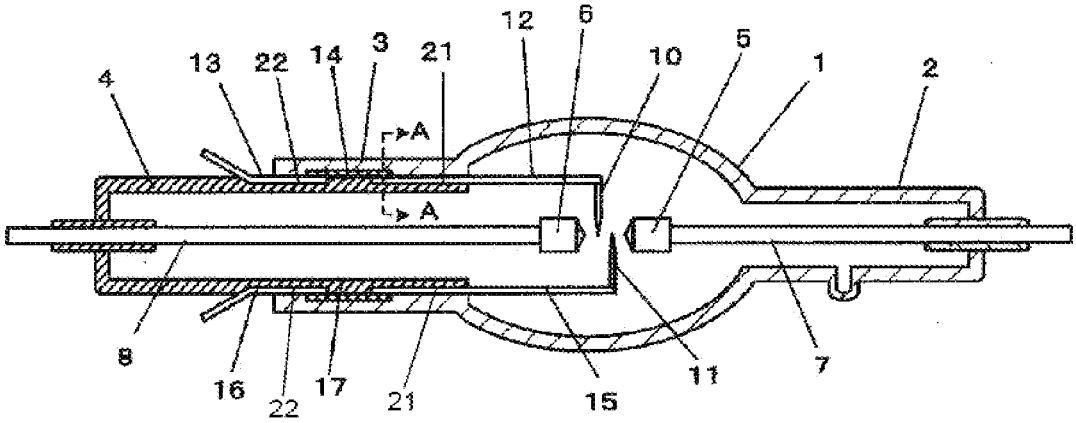
FIG. 1 is a cross-sectional view of a double-capped short arc flash lamp according to one embodiment of the present invention.

A first embodiment of the present invention will be described with reference to FIG. 1 that illustrates an overall cross-sectional view of a double-capped short arc flash lamp, FIG. 2 that illustrates a cross-sectional view taken along the line A-A in FIG. 1, and FIG. 3 that illustrates a cross-sectional view taken along the line B-B in FIG. 2. Like reference numerals are used to designate like components of the double-capped short arc flash lamp in FIGS. 1-3 and FIGS. 6-7.

Figure 2:
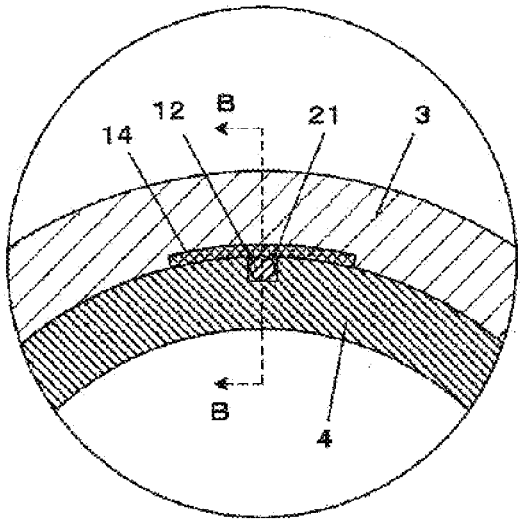
FIG. 2 is a partial cross-sectional view taken along the line A-A in FIG. 1.
Figure 3:
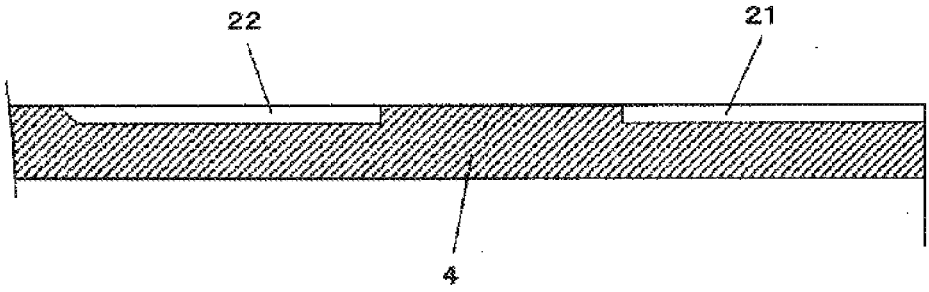
FIG. 3 is a partial cross-sectional view taken along the line B-B in FIG. 2.

As schematically shown in FIG. 1 and precisely shown in FIGS. 2 and 3, the double-capped short arc flash lamp has a pair of main electrodes 5 and 6, a pair of auxiliary electrodes 10 and 11 for starting (triggering discharge), a first sealing tube 2, a second sealing tube 3, and a sealing glass tube 4. In an overlapping area between the second sealing tube 3 and the sealing glass tube 4, there are formed lead receiving grooves 21 and 22 in the outer surface (outer circumference) of the sealing glass tube 4. The grooves 21 and 22 extend in the axial direction of the sealing glass tube 4. An upper pair of grooves 21 and 22 are associated with the first (upper) auxiliary electrode 10, and a lower pair of grooves 21 and 22 are associated with the second (lower) auxiliary electrode 11. The two pairs of grooves 21 and 22 are formed on the opposite surface portions of the glass tube 4. The arc tube 1 may be made of glass.

A first inner lead 12 is connected to the first auxiliary electrode 10, and is received in the lead receiving groove 21. A first outer lead 13 of the first auxiliary electrode 10 is received in the lead receiving groove 22.

Likewise, a second inner lead 15 is connected to the second auxiliary electrode 11, and is received in the lead receiving groove 21. A second outer lead 16 of the second auxiliary electrode 11 is received in the lead receiving groove 22.

As apparent from FIG. 2, a first metallic foil 14 is disposed on the outer surfaces of the first inner lead 12 and first outer lead 13, and the first metallic foil 14 is secured on the first inner lead 12 and first outer lead 13 by welding.

Likewise, a second metallic foil 17 is disposed on the outer surfaces of the second inner lead 15 and second outer lead 16, and the second metallic foil 17 is secured on the second inner lead 15 and second outer lead 16 by welding. The first inner lead 12 is separated from the second inner lead 15, and no separate component physically connect the first inner lead to the second inner lead 15.

Figure 6:
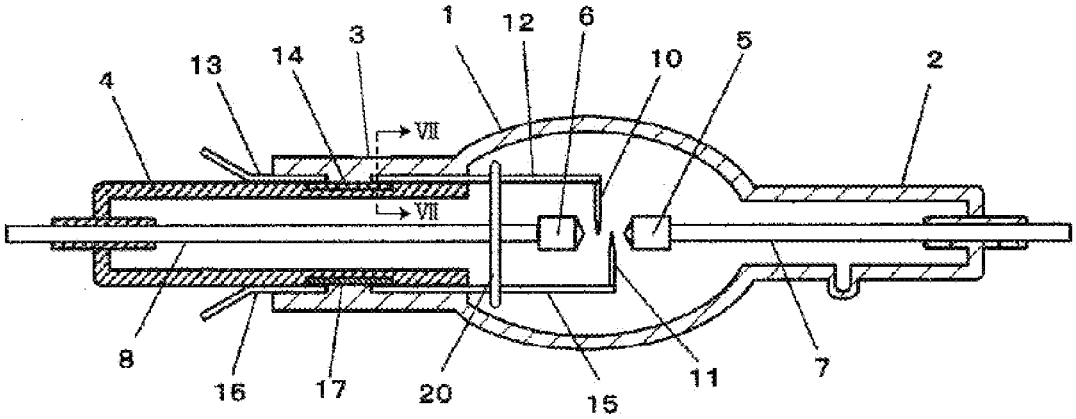
FIG. 6 shows a cross-sectional view of a conventional double-capped short arc flash lamp.
Figure 7:
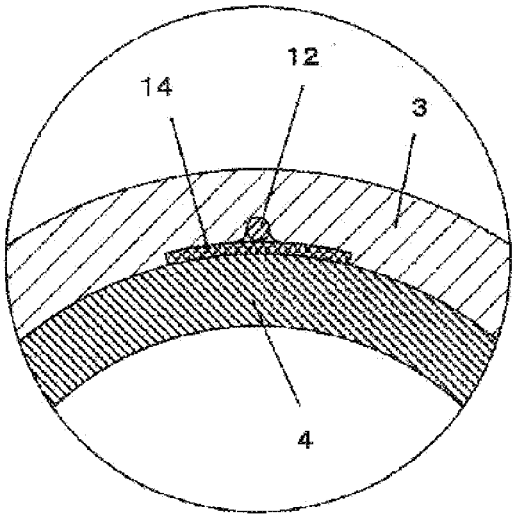
FIG. 7 is similar to FIG. 2 and shows a cross-sectional view taken along the line VII-VII in FIG. 6.

Other configurations of the double-capped short arc flash lamp of this embodiment are similar to those shown in FIG. 6 except for the position fixing supporter 20.

Before the second sealing tube 3 is fused and sealedly joined to the sealing glass tube 4, the inner leads 12 and 15 and the outer leads 13 and 16 are received in the grooves 21 and 22 in the outer surface of the sealing glass tube 4, and the metallic foils 14 and 17 which are welded to the inner and outer leads 12, 15, 13 and 16 are arranged to extend along the outer surface of the glass tube 4. Then, the sealing glass tube 4 is received in the second sealing tube 3, and the second sealing tube 3 is heated from outside such that the second sealing tube 3 is fused and joined to the sealing glass tube 4.

As such, the positions of the inner leads 12 and 15 and outer leads 13 and 16 are fixed on the sealing glass 4, and no positional deviation occurs. As a result, accurate positioning of the auxiliary electrodes 10 and 11 is achieved.

Because the metallic foils 14 and 17 are located on the outside of the inner leads 12 and 15 and outer leads 13 and 16, no clearance is formed around the inner and outer leads when the second sealing tube 3 is fused and jointed to the glass tube 4.

It should be noted that the groove 21 may be continuous to the groove 22 in the axial direction of the glass tube 4. As shown in FIG. 3, however, the groove 21 is separate (independent) from the groove 22 in this embodiment. Because the groove 21 is not continuous from the groove 22 in the axial direction of the glass tube 4, it is possible to reliably prevent leakage of a gas, which is generated upon lighting in the arc tube 1, to the outside through the grooves 21 and 22. By causing the rear ends of the inner leads 12 and 15 to abut on the rear ends of the associated grooves 21, it is possible to accurately position the auxiliary electrodes 10 and 11 in the axial direction of the glass tube 4.

As shown in FIG. 2, the inner lead 12 fits in the groove 12. The metallic foil 14 extends over the inner lead 12 and outer lead 13, and therefore the metallic foil 14 serves as a lid over the inner lead 12 received in the groove 21, and over the outer lead 13 received in the groove 22. The metallic foil 14 is embedded in the second sealing tube 3.

As shown in FIG. 1, the second sealing tube 3 extends over the inner lead 12 and outer lead 13, and serves as a lid over the inner lead 12 and outer lead 13.

Second Embodiment

Figure 4:
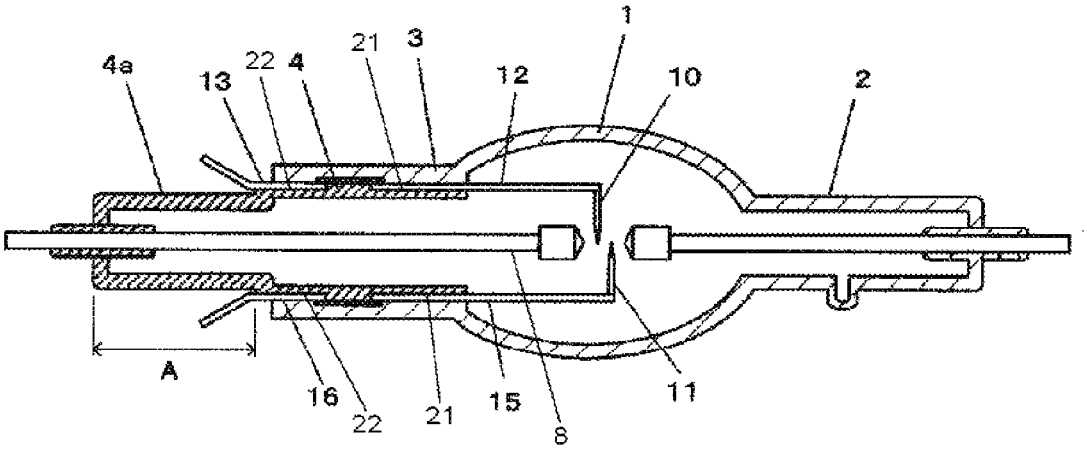
FIG. 4 is a cross-sectional view of a double-capped short arc flash lamp according to another embodiment of the present invention.

Referring to FIG. 4, a second embodiment of the present invention will be described. Like reference numerals are used to designate like components in the first and second embodiments. The second embodiment is different from the first embodiment of FIG. 1 in that the sealing glass tube 4 has a reduced diameter portion 4*a* that extends rearward (to the left in FIG. 4) from the second sealing tube 3 (extends outside the second sealing tube 3) in the region A. In other words, the rear portion (outside portion) 4*a* of the sealing glass 4 has a smaller diameter than that portion of the sealing glass 4 which overlaps the second sealing tube 3.

Because the sealing glass tube 4 has the rear portion 4*a* having a reduced diameter that defines a step portion, rearward (backward, outward) movements of the outer leads 13 and 16 received in the grooves 22 become easier.

Third Embodiment

Figure 5:
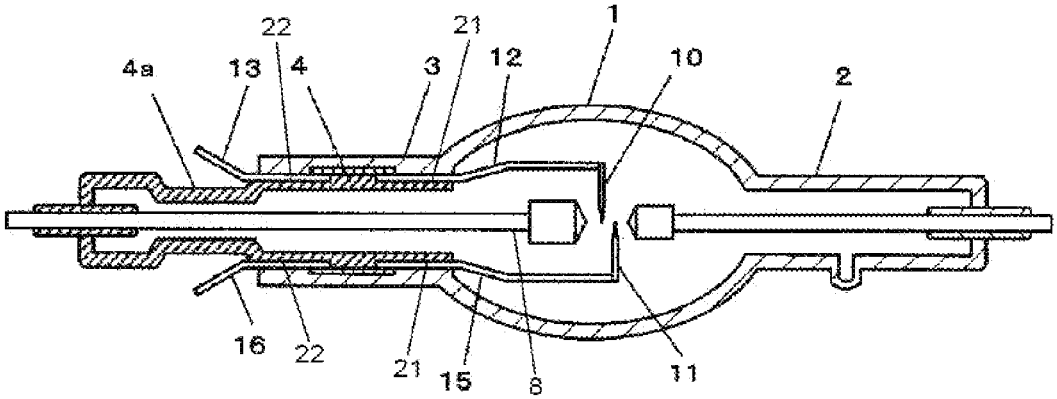
FIG. 5 is a cross-sectional view of a double-capped short arc flash lamp according to still another embodiment of the present invention.

Referring to FIG. 5, a third embodiment of the present invention will be described. The third embodiment is a modification to the second embodiment. Like reference numerals are used to designate like components in the second and third embodiments. The third embodiment is different from the second embodiment in that the rear portion 4*a* of the sealing glass tube 4 has a further reduced diameter, as compared with the configuration shown in FIG. 4. The rear portion 4*a* having the further reduced diameter further facilitates the rearward movements of the outer leads 13 and 16 received in the grooves 22. In this configuration, the sealing between the rear end of the sealing glass tube 4 and the electrode core wire 8 is made by a graded seal (not shown), and the rear end of the sealing glass tube 4 has a larger diameter than the reduced diameter portion 4*a* due to the design of the graded seal and/or the work associated with the graded seal.

As described above, the double-capped short arc flash lamp according to the embodiments of the present invention has the grooves for receiving the leads, and the grooves are formed in (on) the outer circumference of the sealing glass tube in a region where the second sealing tube and the sealing glass tube overlap. The grooves extend in the axial direction of the sealing glass tube. Therefore, the inner leads connected to the auxiliary electrodes and the outer leads connected to the inner leads via the metallic foils can be received (engaged) in the grooves. Thus, when the second sealing tube and the sealing glass tube are fused and joined to each other, the leads do not move. This significantly simplifies the fusing and joining work. Because the inner leads do not change the positions, the positions of the auxiliary electrodes extending from the front ends of the inner leads become stable (do not move) and accurate. Consequently, the discharge is reliably generated between the main electrodes upon feeding the electric power to the auxiliary electrodes of the flash lamp.

Furthermore, an undesired force is not applied between each inner lead and the associated metallic foil and between each outer lead and the associated metallic foil. Therefore, the welded portion between each inner lead and the associated metallic foil is not separated (does not peel), the welded portion between each outer lead and the associated metallic foil is not separated (does not peel), and the metallic foils are not broken.

Also, no separate supporter is necessary for physically connecting the inner leads to each other. This simplifies the structure of the flash lamp, and the second sealing tube does not have to have a large diameter. As a result, the light shielding region does not become large.

It should be noted that the present invention is not limited to the above-described embodiments. For example, the cross sectional shape of the groove 21, 22 may have any suitable shape as long as the grooves 21, 22 can receive the inner and outer leads 12, 13, 15, 17. Although the cross sectional shape of the groove 21, 22 in the illustrated embodiments is square, the cross sectional shape may be other polygonal such as triangular, rectangular, or pentagonal. The groove having a triangular cross section may be referred to as a V-shaped groove. The groove having a square or rectangular cross section may be referred to as a U-shaped groove.

While certain embodiments have been described, these embodiments have been presented by way of example only, and are not intended to limit the scope of the present invention. The novel apparatuses described herein may be embodied in a variety of other forms; furthermore, various omissions, substitutions and changes in the form of the apparatuses described herein may be made without departing from the gist of the present invention. The accompanying claims and their equivalents are intended to cover such forms or modifications as would fall within the scope and gist of the present invention.

The present application is based upon and claims the benefit of a priority from Japanese Patent Application No. 2013-222898, filed Oct. 28, 2013, and the entire content of which is incorporated herein by reference.

What is claimed is:

1. A double-capped short arc flash lamp comprising:

an arc tube made of glass, and having a first end and a second end opposite the first end;

a pair of first and second main electrodes disposed in the arc tube;

a pair of first and second auxiliary electrodes disposed in the arc tube, the pair of auxiliary electrodes being used to trigger discharge;

a first inner lead and a first outer lead associated with the first auxiliary electrode;

a second inner lead and a second outer lead associated with the second auxiliary electrode;

a first sealing tube provided at the first end of the arc tube;

a second sealing tube provided at the second end of the arc tube;

a first core wire extending from the first main electrode in the first sealing tube, and protruding out of the first sealing tube, the first core wire being sealed to the first sealing tube;

a sealing glass tube partly received in the second sealing tube, the sealing glass tube being fused and joined to the second sealing tube, the sealing glass tube having an outer surface and an axial direction;

a second core wire extending from the second main electrode in the sealing glass tube, and protruding out of the sealing glass tube, the second core wire being sealed to the sealing glass tube;

a first groove formed in the outer surface of the sealing glass tube in a region where the sealing glass tube overlaps the second sealing tube, the first groove extending in the axial direction of the sealing glass tube, the first groove being configured to receive the first inner lead and the first outer lead;

a second groove formed in the outer surface of the sealing glass tube in the region where the sealing glass tube overlaps the second sealing tube, the second groove extending in the axial direction of the sealing glass tube, the second groove being configured to receive the second inner lead and the second outer lead, the second groove being formed at a different location than the first groove;

a first metallic foil configured to electrically connect the first inner lead with the first outer lead; and a second metallic foil configured to electrically connect the second inner lead with the second outer lead.

2. The double-capped short arc flash lamp according to claim 1, wherein the first metallic foil is disposed outside the first inner lead and the first outer lead, and the second metallic foil is disposed outside the second inner lead and the second outer lead.

3. The double-capped short arc flash lamp according to claim 1, wherein the first groove is not continuous in the axial direction of the sealing glass tube, and the second groove is not continuous in the axial direction of the sealing glass tube.

4. The double-capped short arc flash lamp according to claim 1, wherein that portion of the sealing glass tube which is not received in the second sealing tube has a reduced diameter.

5. The double-capped short arc flash lamp according to claim 2, wherein the first groove is not continuous in the axial direction of the sealing glass tube, and the second groove is not continuous in the axial direction of the sealing glass tube.

6. The double-capped short arc flash lamp according to claim 2, wherein that portion of the sealing glass tube which is not received in the second sealing tube has a reduced diameter.

7. The double-capped short arc flash lamp according to claim 3, wherein that portion of the sealing glass tube which is not received in the second sealing tube has a reduced diameter.

8. The double-capped short arc flash lamp according to claim 4 further including a graded seal configured to seal between the sealing glass tube and the second core wire.

9. The double-capped short arc flash lamp according to claim 1, wherein the first groove is continuous in the axial direction of the sealing glass tube, and the second groove is continuous in the axial direction of the sealing glass tube.

10. The double-capped short arc flash lamp according to claim 1, wherein the first inner lead is separated from the second inner lead.

11. The double-capped short arc flash lamp according to claim 1, wherein the first inner lead and the first outer lead fit in the first groove, and the second inner lead and the second outer lead fit in the second groove.

12. The double-capped short arc flash lamp according to claim 1, wherein the first metallic foil serves as a first lid over the first inner lead and the first outer lead received in the first groove, and the second metallic foil serves a second lid over the second inner lead and the second outer lead received in the second groove.

13. The double-capped short arc flash lamp according to claim 1, wherein the first metallic foil is embedded in the second sealing tube, and the second metallic foil is also embedded in the second sealing tube at a different location from the first metallic foil.

14. The double-capped short arc flash lamp according to claim 1, wherein the second sealing tube serves as a lid over the first inner lead and the first outer lead received in the first groove, and over the second inner lead and the second outer lead received in the second groove.

15. The double-capped short arc flash lamp according to claim 1, wherein at least one of the first and second grooves has a polygonal cross section.

16. A double-capped short arc flash lamp comprising:

an arc tube having a first end and a second end opposite the first end;

a pair of first and second main electrodes disposed in the arc tube;

a pair of first and second auxiliary electrodes disposed in the arc tube;

a first lead electrically connected to the first auxiliary electrode;

a second lead electrically connected to the second auxiliary electrode;

a first sealing tube extending from the first end of the arc tube;

a second sealing tube extending from the second end of the arc tube;

a first core wire extending from the first main electrode in the first sealing tube and protruding out of the first sealing tube, the first core wire being sealed to the first sealing tube;

a sealing glass tube partly received in the second sealing tube, the sealing glass tube having an outer surface and an axial direction;

a second core wire extending from the second main electrode in the sealing glass tube and protruding out of the sealing glass tube, the second core wire being sealed to the sealing glass tube;

a first groove formed in the outer surface of the sealing glass tube in a region where the sealing glass tube overlaps the second sealing tube, and extending in the axial direction of the sealing glass tube, the first groove being configured to receive the first lead; and a second groove formed in the outer surface of the sealing glass tube in the region where the sealing glass tube overlaps the second sealing tube, and extending in the axial direction of the sealing glass tube, the second groove being configured to receive the second lead, the second groove being formed at a different location than the first groove.

17. The double-capped short arc flash lamp according to claim 16, wherein that portion of the sealing glass tube which is not received in the second sealing tube has a reduced diameter.

18. The double-capped short arc flash lamp according to claim 17 further including a graded seal configured to seal between the sealing glass tube and the second core wire.

19. The double-capped short arc flash lamp according to claim 16, wherein the second sealing tube serves as a lid over the first lead received in the first groove, and over the second lead received in the second groove.

20. The double-capped short arc flash lamp according to claim 16, wherein at least one of the first and second grooves has a polygonal cross section.

* * * * *